United States Patent [19]

Kowal

[11] Patent Number: 4,485,609

[45] Date of Patent: Dec. 4, 1984

[54] TORQUE LIMITED CAP APPLICATING HEAD

[75] Inventor: Samuel J. Kowal, Maumee, Ohio

[73] Assignee: Owens-Illinois, Inc., Toledo, Ohio

[21] Appl. No.: 335,291

[22] Filed: Dec. 28, 1981

[51] Int. Cl.[3] ..... B67B 3/20; B65B 7/28

[52] U.S. Cl. ..... 53/331.5

[58] Field of Search ..... 53/317, 331, 331.5; 192/84 PM, 56 R, 110 R; 403/164, 165; 464/29

[56] References Cited

U.S. PATENT DOCUMENTS

| | | | |
|---|---|---|---|
| 3,031,822 | 5/1962 | Dimond | 53/317 |
| 4,222,215 | 9/1980 | Takano | 53/331.5 |
| 4,254,603 | 3/1981 | Obrist | 53/331.5 |
| 4,295,320 | 10/1981 | Willingham | 53/331.5 |
| 4,364,218 | 12/1982 | Obrist | 53/331.5 |

*Primary Examiner*—R. L. Spruill
*Assistant Examiner*—Donald R. Studebaker
*Attorney, Agent, or Firm*—John R. Nelson; Myron E. Click

[57] ABSTRACT

The invention relates to a limited torque applicating mechanism for applying caps to the threaded necks of containers. Torque is transmitted to a conventional cap applicating head from a rotating power shaft by positioning a ring of permanent magnets on either the driven or driving element and disposing a ring of high magnetic permeability material concentrically adjacent on the other of the driven or driving elements so that the torque transmitted between the driving and driven elements is limited by the magnetic attraction between the ring of permanent magnets and the ring of high permeability magnetic material. The apparatus further incorporates a mechanism for adjusting the relative axial position of the ring of permanent magnets with respect to the ring of high magnetic permeability material to permit selective adjustment of the amount of torque transmitted.

6 Claims, 3 Drawing Figures

TORQUE LIMITED CAP APPLICATING HEAD

BACKGROUND OF THE INVENTION

1. Field of the Invention

The invention relates to a capping head assembly for applying threaded caps to the threaded neck of a container with the maximum applicable torque being selectively adjustable.

2. History of the Prior Art

A common feature on cap applicating machines for applying threaded caps to the threaded neck of containers is a torque limiting mechanism preventing excessive torque being applied to the cap which would result either in the jamming of the cap on the container neck so that it could not be manually removed by the ultimate consumer, or the actual breakage of the cap due to the application of excessive torque.

Magnetic elements have heretofore been proposed as a means for effecting the transmission of a limited degree of torque from a power driven spindle to a cap applicating head assembly, but all such prior art mechanisms were incapable of convenient adjustment of the maximum torque to conform to the requirements of different sizes of caps to be applied by the applicating machine.

SUMMARY OF THE INVENTION

The invention provides a torque limited cap applicator for effecting the threaded assemblage of a cap to the threaded neck of a container without imposing an applicating torque on the cap in excess of a predetermined value. A sleeve-like coupling spindle is provided which is attachable for co-rotation to the cap applicating spindle of any conventional cap applicating machine. The spindle sleeve is provided at its upper end with an externally threaded portion, and at its lower end with a bearing mounting portion. An annular housing is provided with internal threads at its upper end for engagement with the threads on the spindle and its lower end is disposed in radially spaced, surrounding relationship to the bearing mounting portion of the spindle sleeve. A conventional cap applicating head assembly is provided with an upstanding annular extension which is concentrically insertable within the forementioned annular chamber. An anti-friction bearing mounts the upstanding extension in freely rotatable relationship relative to the spindle sleeve. A peripheral array of permanent magnets is mounted on the external periphery of the applicating head extension. The primary flux path for the magnetic flux developed by the peripheral array of permanent magnets is defined by a ring of high magnetic permeability material mounted on the interior of the adjacent annular housing portion. Adjustment of the threaded engagement between the sleeve spindle and the annular housing thus effects a variation in the axial position of the peripheral array of permanent magnets relative to the ring of high permeability material and thus determines the degree of magnetic attraction between the magnets and the ring, hence the effective torque transmitted from the power driven rotating sleeve spindle to the applicating head assembly.

Further objects and advantages of the invention will be readily apparent to those skilled in the art from the following detailed description, taken in conjunction with the annexed sheets of drawings.

DESCRIPTION OF PREFERRED EMBODIMENT

Figure 2:
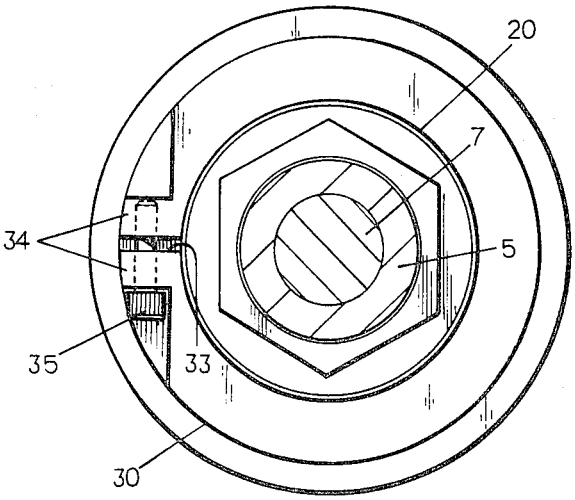
FIG. 2 is a sectional view taken on the plane 2—2 of FIG. 1.
Figure 3:
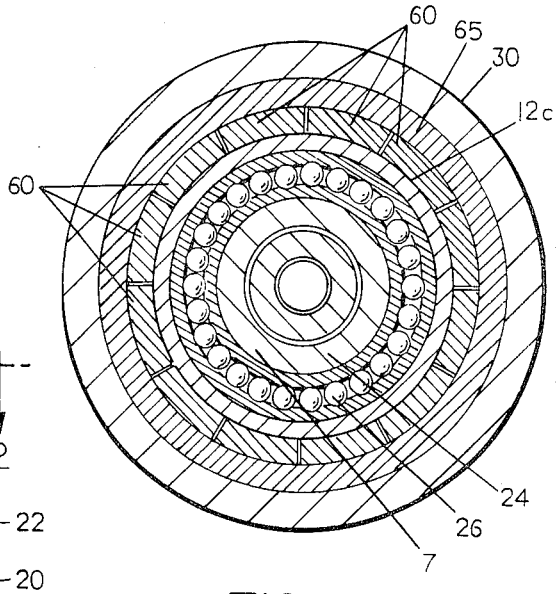
FIG. 3 is a sectional view taken on the plane 3—3 of FIG. 1.

Referring to the drawings, a conventional cap applicating head assembly 10 is shown in assembled relationship to a power driven, rotating hollow shaft 5 which is conventionally mounted and driven in a rotating turret of a cap applicating machine (not shown) to position the cap applicating head 10 in alignment with the top of an internally threaded cap (not shown) to rotate the cap into assembly with the threaded neck of a container (not shown). The transmission of torque from the hollow shaft 5 to the cap applicating head assembly 10 is accomplished through the utilization of a torque transmitting mechanism embodying this invention.

The torque transmitting mechanism comprises a spindle sleeve 20 which is internally threaded at 21 for co-rotational mounting on the threaded bottom end of the hollow machine shaft 5. An annular seal 6 effects a sealing of the threaded joint to prevent the entrance of foreign material. Spindle sleeve 20 is further provided at its upper end with an externally threaded section 22. At its lower end, there is provided a sleeve-like downward extension 24, the outer surface 24*a* of which defines a mounting for an anti-friction bearing unit 26.

An annular housing 30 is provided having an upper internally threaded section 32 for cooperation with the external threads 22 on the spindle sleeve 20. A horizontal slit 31 is provided in the upper portion of the housing 30 and this slip is intersected by a vertical radial slit 33 to define a pair of integral clamping ears 34 which can be pulled into clamping engagement around the spindle sleeve threads 22 by a bolt 35. It is therefore apparent that the housing 30 may be locked in any selected axial position relative to the spindle sleeve 20 by tightening the bolt 35. The lower portion 36 of the annular housing has a large counterbore 37 surrounding the annular downward extension 24 of the spindle sleeve 20 and defines an annular chamber therebetween.

The cap engaging head 10 is of conventional construction, incorporating a primary cap engaging element 11 of cup shaped configuration which is slidably mounted within an upwardly extending mounting sleeve 12 by virtue of having radial pins 13 engaged in axial slots 14 in the mounting sleeve 12. The primary cap engaging head 11 is normally biased to its lowermost position relative to the mounting sleeve 12 by a compressed spring 15 of conical configuration, the lower end of which rests on the top rim surface of the cup shaped element 11 and the upper end abuts a plate 16 which in turn abuts a snap ring 17 inserted in the wall of the connecting sleeve 12. A pilot cap engaging head 40 is slidably mounted within a central aperture 11*a* provided in the primary cap engaging element 11. The pilot cap engaging element 40 is of a cup shaped configuration and has an enlarged diameter upper portion 41 slidably engaged with the interior side walls 11*b* of the primary element 11. The pilot element 40 is spring biased to its illustrated position by a compressed spring 42 which at its upper end abuts a collar 44 provided on a spring guide 46. Spring guide 46 has an elongated shaft portion 48 fitting freely within the bore 7*a* of a vertical positioning shaft 7 freely mounted within the bore of the rotating power shaft 5. The vertical movements of shaft 7 are conventionally controlled by the applicating machine (not shown) in the proper time sequence relative to the positioning of the cap applicating mechanism 10 above the top of a cap which has been preliminarily positioned on the threaded neck of a container. Such construction is entirely conventional and forms no part of the instant invention.

In accordance with this invention, the upper portion 12*a* of the connecting sleeve 12 is of increased radial thickness and extends into the annular chamber within wall 37. The anti-friction bearing 26 is mounted between the inner bore surface 12*b* of the connecting sleeve 12 and the bearing mounting surface 24*a* of the housing extension 24. Axial displacement of the connecting sleeve 12 and the annular housing 20 is prevented by snap rings 27 which also hold the bearings 26 in their desired axial position. The top portion of connecting sleeve 12 is provided with a reduced exterior diameter 12*c* and a plurality of peripherally spaced permanent magnet segments 60 are cemented to the exterior of the reduced diameter section 12*c*. Immediately opposite the permanent magnets 60 is the enlarged counterbore 37 in annular housing 30 and a ring 65 of high magnetic permeability material is press fitted, or otherwise suitably secured in counterbore 37. The ring 65 provides the lowest resistance path for the magnetic flux generated by the permanent magnets 60. Such ring may be fabricated from any one of several well known high magnetic permeability materials, such as the material sold under the trademark "HYSTERLOY" by Permag Magnetics Corp.

Figure 1:
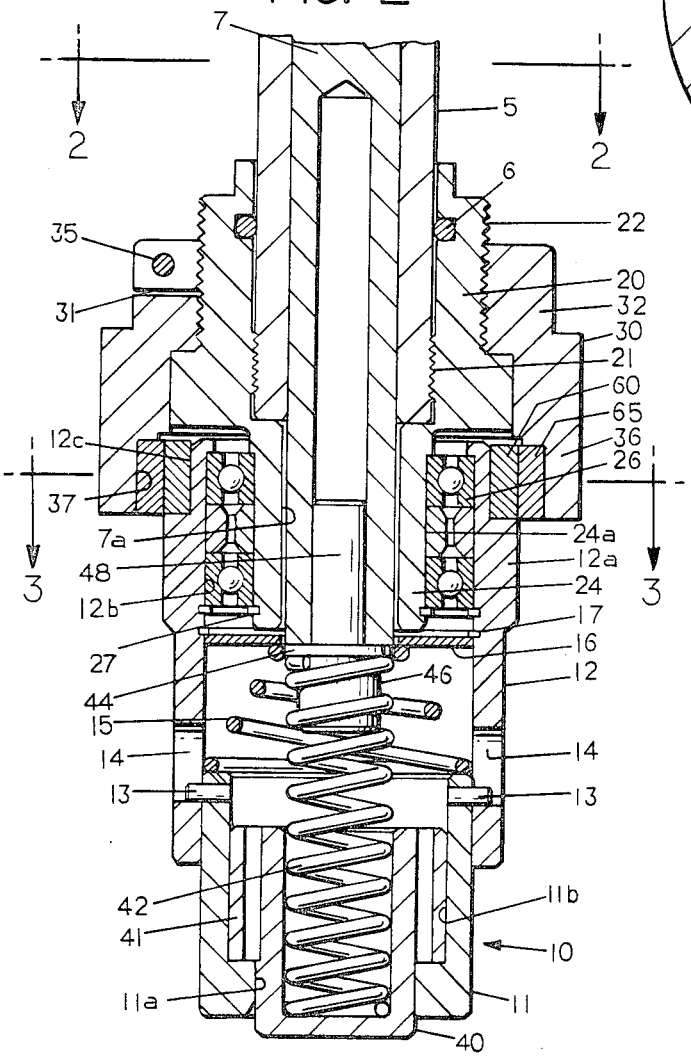
FIG. 1 is a vertical sectional view of a cap applicating head mounted on a power driven applicating spindle by a limited torque mechanism embodying this invention.

In the position of the coupling sleeve 12 and the housing 30 illustrated in the drawings, the high magnetic permeability ring 65 is positioned in axial alignment with the peripheral array of permanent magnets 60, and thus a maximum magnetic attraction exists between these two elements. Hence rotating torque can be transmitted from the power driven rotating shaft 5 to the cap applicating head 10 until the opposing forces exceed the magnetic attraction of the permanent magnets 60 relative to the magnetically permeable ring 65. In the event that it is desired to reduce the torque thus transmitted, the axial position of the housing 30 relative to the spindle sleeve 20 can be adjusted by loosening the bolt 35 and then threading the housing 30 upwardly with respect to the spindle sleeve 20, following which the clamping bolt 35 is again tightened. Any change in the axial position of the array of permanent magnets 60 with respect to the high magnetic permeability ring 65 from that shown in FIG. 1 will reduce the magnetic attraction between these elements, hence will reduce the maximum torque that can be transmitted by the rotating power shaft 5 to the cap applicating head 10.

Modifications of this invention will be readily apparent to those skilled in the art. For example, the peripheral array of permanent magnets 60 could be installed in the counterbore 37 formed in the annular housing 30 and the ring 65 of high magnetic permeability material could be mounted on the exterior of the reduced diameter section 12*c* of the connecting sleeve 12. Accordingly, the scope of the invention should be determined solely by the appended claims.

What is claimed is:

1. A limited torque cap applicator comprising, in combination, a power driven rotatable first element, a cap applicating assemblage incorporating a rotatable second element adapted to be coupled with and driven by said first element, means for magnetically coupling said first and second elements together for limited torque driving of the second element comprising a ring of peripherally spaced permanent magnets mounted on one of said elements and a concentric ring constructed of high magnetic permeability material mounted on the other of said elements, said ring of magnets and said concentric ring of said magnetic material being located radially adjacent each other such that one annularly surrounds the other for transmitting torque to said second element limited by the magnetic attraction between the ring of permanent magnets and the concentric ring of high magnetic permeability material.

2. A torque limited applicator of claim 1 plus means for telescopically adjusting the relative axial position of the ring of permanent magnets and the ring of high magnetic permeability material.

3. A torque limited cap applicator comprising, in combination, a rotatably driven vertical axis spindle, an annular housing co-rotatably secured to said spindle and including an enlarged counterbore a cap engaging head assembly including an upstanding annular extension concentrically disposed within said enlarged counterbore and having a reduced diameter portion, said reduced diameter portion of said extension and the enlarged counterbore of said housing together defining an annular chamber therebetween, bearing means for rotatably mounting said annular extension on said spindle, a plurality of peripherally spaced, vertically disposed magnets mounted on the outer periphery of the reduced diameter portion of said annular extension, and a ring of high magnetic permeability material mounted in the enlarged counterbore of said annular housing radially adjacent and surrounding said magnets, whereby the magnetic attraction between said magnets and said ring solely transfers torque from said spindle to said cap engaging head assembly.

4. The torque limited cap applicator of claim 3 plus means for adjusting the vertical position of said housing relative to said spindle, thereby effecting the radial surrounding relationship of the magnets by the said magnetic ring by telescopically adjusting the relative vertical positions of said magnets and said ring to adjust the magnetic attraction and the torque transmitted thereby.

5. A torque limited cap applicator comprising a rotatably driven, vertical axis spindle having an externally threaded upper portion and a lower bearing mounting portion, an annular housing having an internally threaded upper portion engaged with said externally threaded upper portion of said spindle and a lower portion defining an annular chamber encircling said bearing mounting portion of said spindle, a cap engaging head assembly including an upstanding annular extension concentrically disposed within said annular chamber, bearing means for rotatably mounting said annular extension on said bearing mounting portion of said spindle, a plurality of peripherally spaced, vertically disposed permanent magnets mounted on the outer periphery of said annular extension and adjacent said chamber, and a ring of high magnetic permeability material mounted in said chamber of the annular housing adjacent said magnets, whereby the magnetic attraction between said magnets and said ring solely determines the torque transferred from said spindle to said cap engaging head assembly.

6. The torque limited cap applicator of claim 5 plus means for locking said internally threaded upper portion of said annular housing in any selected vertical position relative to said spindle, thereby telescopically adjusting the relative vertical positions of said magnets and said ring to adjust the magnetic attraction and the torque transmitted thereby.

* * * * *